US007360390B2

(12) United States Patent
Lavalliere

(10) Patent No.: US 7,360,390 B2
(45) Date of Patent: Apr. 22, 2008

(54) METHOD FOR SECURING CORNER CONNECTORS WITHIN A DUCT SECTION

(76) Inventor: Richard R. Lavalliere, 7576 Hawks Landing, West Palm Beach, FL (US) 33412

( * ) Notice: Subject to any disclaimer, the term of this patent is extended or adjusted under 35 U.S.C. 154(b) by 57 days.

(21) Appl. No.: 11/387,030

(22) Filed: Mar. 22, 2006

(65) Prior Publication Data

US 2007/0220943 A1 Sep. 27, 2007

(51) Int. Cl.
*B21D 39/03* (2006.01)
*B21D 19/00* (2006.01)

(52) U.S. Cl. ..... 72/409.18; 72/409.01; 72/461; 29/243.58; 29/283.5

(58) Field of Classification Search ..... 72/409.18, 72/409.13, 409.01, 461, 325; 29/243.5, 243.46, 29/243.57, 243.58, 267, 283.5, 243.53, 243.54
See application file for complete search history.

(56) References Cited

U.S. PATENT DOCUMENTS

| | | | | |
|---|---|---|---|---|
| 1,487,543 | A * | 3/1924 | Dingwall | 29/243.56 |
| 2,106,121 | A | 1/1938 | Lorenzo | |
| 2,351,049 | A * | 6/1944 | Kaman | 72/441 |
| 2,360,111 | A | 10/1944 | Dedona | |
| 4,158,955 | A * | 6/1979 | Bustin | 72/414 |
| 4,466,641 | A | 8/1984 | Heilman et al. | |
| 4,579,375 | A | 4/1986 | Fischer et al. | |
| 4,713,959 | A | 12/1987 | Bennett | |
| D302,644 | S * | 8/1989 | Townend | D8/52 |
| 5,020,202 | A | 6/1991 | Turrell | |
| 5,090,101 | A * | 2/1992 | Welty | 29/243.5 |
| 5,094,097 | A * | 3/1992 | Tooth et al. | 72/409.01 |
| 5,283,944 | A | 2/1994 | Goodhue | |
| 5,375,312 | A * | 12/1994 | Sakurai et al. | 29/243.5 |
| 5,661,886 | A * | 9/1997 | Smith | 29/243.56 |
| 5,761,948 | A * | 6/1998 | Malagnoux | 72/325 |
| 5,926,937 | A | 7/1999 | Goodhue | |
| 6,175,998 | B1 | 1/2001 | Leo | |
| 6,233,803 | B1 | 5/2001 | Rose | |
| 6,311,534 | B1 | 11/2001 | Shah et al. | |
| 6,412,519 | B1 | 7/2002 | Goodhue | |
| 6,421,900 | B1 | 7/2002 | Hunt | |
| 6,547,287 | B1 | 4/2003 | Shah et al. | |
| 6,561,553 | B1 | 5/2003 | Issagholian-Havai | |
| 6,810,570 | B2 | 11/2004 | Fischer et al. | |
| D506,115 | S * | 6/2005 | King | D8/54 |
| 2006/0179911 | A1 * | 8/2006 | Galluzo | 72/409.01 |

* cited by examiner

*Primary Examiner*—Daniel C Crane
(74) *Attorney, Agent, or Firm*—McLane, Graf, Raulerson & Middleton, P.A.; Scott C. Rand

(57) ABSTRACT

The present disclosure relates to an apparatus for securing a corner connector to a rectangular duct section having a transverse duct flange. The disclosure also relates to a method for securing a corner connector to a transverse duct flange.

7 Claims, 8 Drawing Sheets

METHOD FOR SECURING CORNER CONNECTORS WITHIN A DUCT SECTION

FIELD OF THE INVENTION

The present invention relates to a hand tool especially adapted for use in attaching a corner connector element to a sheet metal duct flange, and a method employing the same.

BACKGROUND OF THE INVENTION

Various duct-connecting systems are known for connecting sections of heating and air conditioning sheet metal ducts. The duct sections may be formed of galvanized sheet steel, typically of 18-26 gauge thickness. Commonly, the duct sections are of rectangular cross-sectional shape and have integral transverse flanges at an end.

Well-known examples of such transverse duct flange connecting systems include the Transverse Duct Connector (TDC) and Transverse Duct Flange (TDF) systems. In FIG. 1, there appears a fragmentary view of a rectangular duct section 10 employing an exemplary TDC or TDF type flange system. The duct section 10 includes transversely extending flange members 12 extending from each of the duct walls 14. Each flange member 12 includes a first portion 16 extending perpendicular to the elongate or axial direction of the duct. The radially outward edges of the flanges 12 are bent back to form an upstanding, axially-extending lip 18 which extends parallel to the sides 14 of the duct section 10 from which the flanges transversely project to form a generally channel-shaped flange. In the well-known TDC/TDF system, each of the lips 18 is formed of a fold of metal to double the effective thickness of the lip 18 to provide additional reinforcement.

Because the sides 14, transverse flange portion 16, and lips 18 of each duct section 10 are all integrally formed from a single sheet of metal, the flange members 12 do not extend around the corners of the duct sections. Accordingly, right-angle shaped corner connectors 20 having apertures 22 adapted to receive fasteners, such as bolts, are used as the primary means of connecting adjacent duct sections together. The corner connectors each have a pair of legs 24 intersecting at right angles. The two perpendicular legs of the corner connector 20 are seated upon the surfaces of adjacent, mutually perpendicular flange members 12 projecting from adjacent sides 14 of the duct section 10. A peripheral rib or ridge 26 may be formed in the duct wall 14 to facilitate seating or a snap-fit retention of the corner connector 20 within the flange 12. A side cross-sectional view of a corner connector 20 seated within a flange 12 is shown in FIG. 2.

Although only a single corner of a single duct section 10 is shown for ease of illustration, it will be recognized that four corner angle fasteners 20 will be seated on the flanges at each end of a duct section 10 for coupling to another duct section. Likewise, four additional corner angle fasteners 20 will be seated within like flanges on the other duct section to be joined. Bolts are then passed through each pair of facing corner angle fasteners, thereby compressing the flanges at the abutting ends of the joined duct sections.

To prevent the corner connectors from becoming dislodged from the transverse duct flange, e.g., during transport or handling, it is common to secure the corner connectors 20 to the flanges 12 by bending the upstanding lips 18 projecting from the flanges over the corresponding aligned portions of the legs 22 of the corner connectors to form a crimped connection 26 between the flange 12 and corner connector 20. Commonly, a hammer or mallet is used to bend a portion of the flange lip 18 over the right angle connector legs 24. U.S. Pat. No. 4,713,959 discloses a tong- or pliers-like hand tool having specially shaped jaws for bending the upstanding flange lips of a transverse duct flange over the legs of the corner connectors. The tool disclosed in U.S. Pat. No. 4,713,959 is said to overcome noise and efficiency problems associated with pounding over the flange lips using a hammer.

A disadvantage of the above-mentioned pliers-type of crimping tools is that they require that a high amount of force be applied by the user, particularly when used with ducts formed of heavier gauges of sheet metal, such as 18 or 20 gauge. The force required is such that some operators lack sufficient physical strength to perform a bending or crimping operation. Even where the operator possesses a sufficient degree of strength to perform a crimping operation with a pliers-type crimping tool, the stresses applied to the tool due to the degree of force required to bend over the flange lips makes such prior art tools highly susceptible to breakage.

What is needed, therefore, is a crimping tool and method for securing a corner connector to a transverse duct flange which is less physically demanding on the operator and which is suited for use with all gauges of sheet metal, including heavier gauges such as 18 and 20 gauge thicknesses. The present invention contemplates an improved duct flange crimping tool and method which overcome the above-referenced limitations and others.

SUMMARY OF THE INVENTION

In one aspect, an apparatus is provided for crimping a corner connector to a rectangular duct section having a transverse duct flange with a transverse portion extending transversely with respect to an axial direction of the duct and a lip portion extending from the transverse portion in the axial direction. The apparatus includes a head defining a jaw opening sized to receive the transverse duct flange, the head having an inner jaw member, an outer jaw member in spaced-apart, facing relation to the inner jaw member, and an intermediate jaw member extending between the inner and outer jaw members. A first handle extends from the head and a second handle is pivotally attached to the head and is movable between a first, open position and a second, closed position. A plunger is slidably received within a plunger orifice formed within the inner jaw member and is mechanically coupled to the second handle wherein pivoting movement of the second handle from the open position to the closed position causes sliding movement of the plunger from the inner jaw member toward the outer jaw member. The plunger and plunger orifice are positioned within the inner jaw member so that, upon placement of a transverse duct flange within the jaw opening, movement of the second handle from the open position to the closed position will cause a bending over of the transverse duct flange lip portion.

In another aspect, a method for securing a corner connector within a transverse duct flange of a rectangular duct section is provided. First and second legs of a corner connector are placed within first and second adjacent flange portions of the rectangular duct section, each of the flange portions including a transverse portion and an upstanding lip, the transverse portion extending transversely between a duct wall and the lip. A crimping tool is provided, the crimping tool being of a type having a head defining a jaw opening sized to receive the transverse duct flange. The head has an inner jaw member, an outer jaw member in spaced-apart, facing relation to the inner jaw member, and an intermediate jaw member extending between the inner and outer jaw members. A first handle extends from the head and a second handle is pivotally attached to the head and is movable between a first, open position and a second, closed position. A plunger is slidably received within a plunger orifice formed within the inner jaw member and is mechanically coupled to the second handle wherein pivoting movement of the second handle from the open position to the closed position causes sliding movement of the plunger from the inner jaw member toward the outer jaw member. The plunger and plunger orifice are positioned within the inner jaw member so as to be in aligned, facing relation with at least a portion of the lip when the transverse duct flange is received within the jaw opening. For each corner connector leg, the transverse duct flange is inserted into the jaw opening and the second handle is moved to the closed position relative to the first handle so as to cause movement of the plunger member transversely toward the outer jaw member, thereby bending a portion of the upstanding lip over an aligned portion of the corner connector leg.

In more limited aspects, the apparatuses and methods described herein are adapted for use with TDC and/or TDF transverse duct flange systems.

One advantage of the present invention resides in the ease of performing a crimping operation for all sheet metal thicknesses. The present invention provides increased mechanical advantage over the prior art pliers-type crimping tools and requires less physical strength on the part of the user and provides increased ease of use and efficiency as compared to the prior art tools.

Another advantage of the present invention is that it does not rely on a scissor-like action to perform a bending or crimping operation. As such, the stresses placed on the tool are reduced, thereby reducing the susceptibility of the tool to breakage.

Other benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 3:
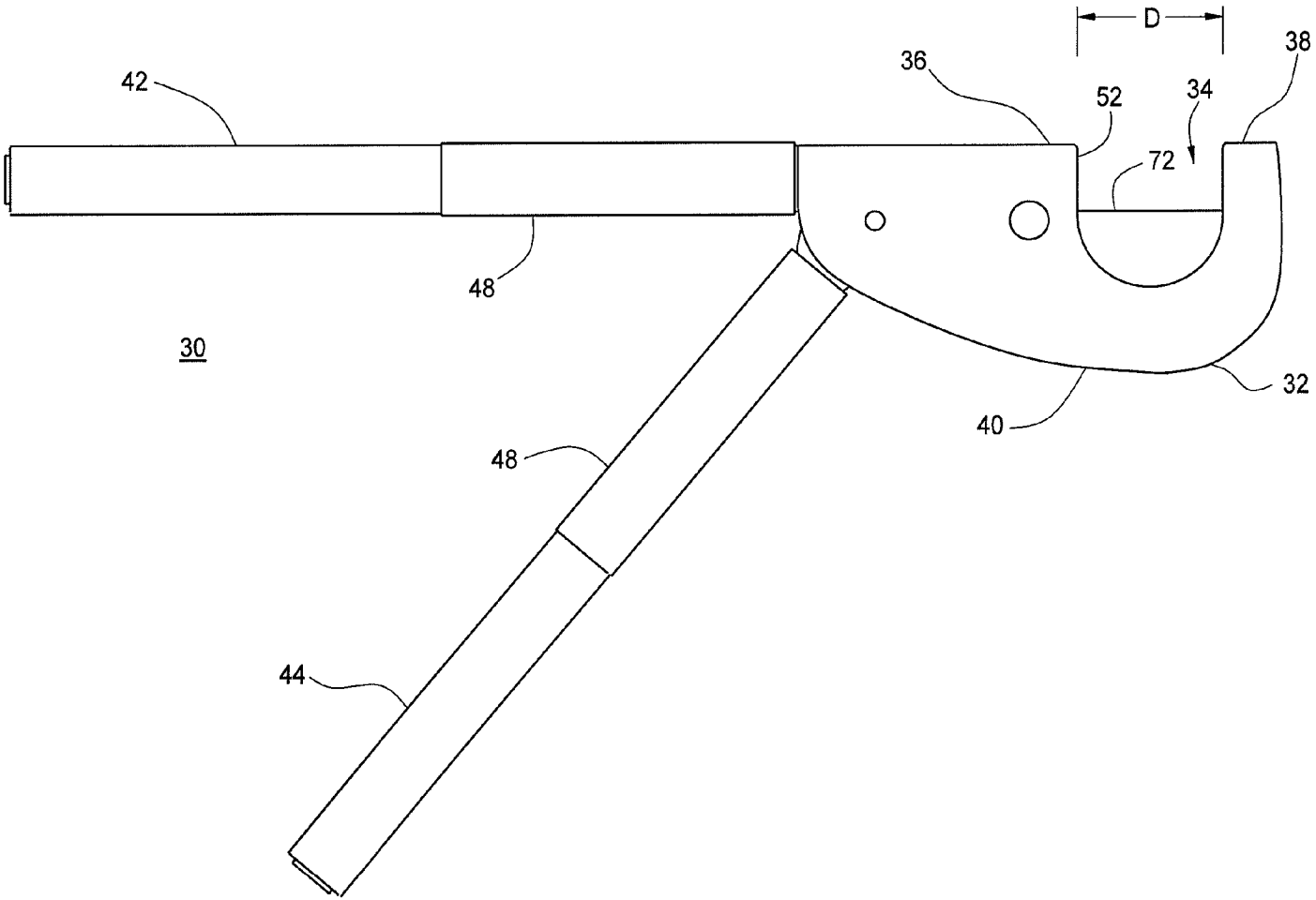
FIG. 3 illustrates a first embodiment crimping tool adapted to bend the upstanding lip of a transverse duct flange over a corner connector received therein.
Figure 4:
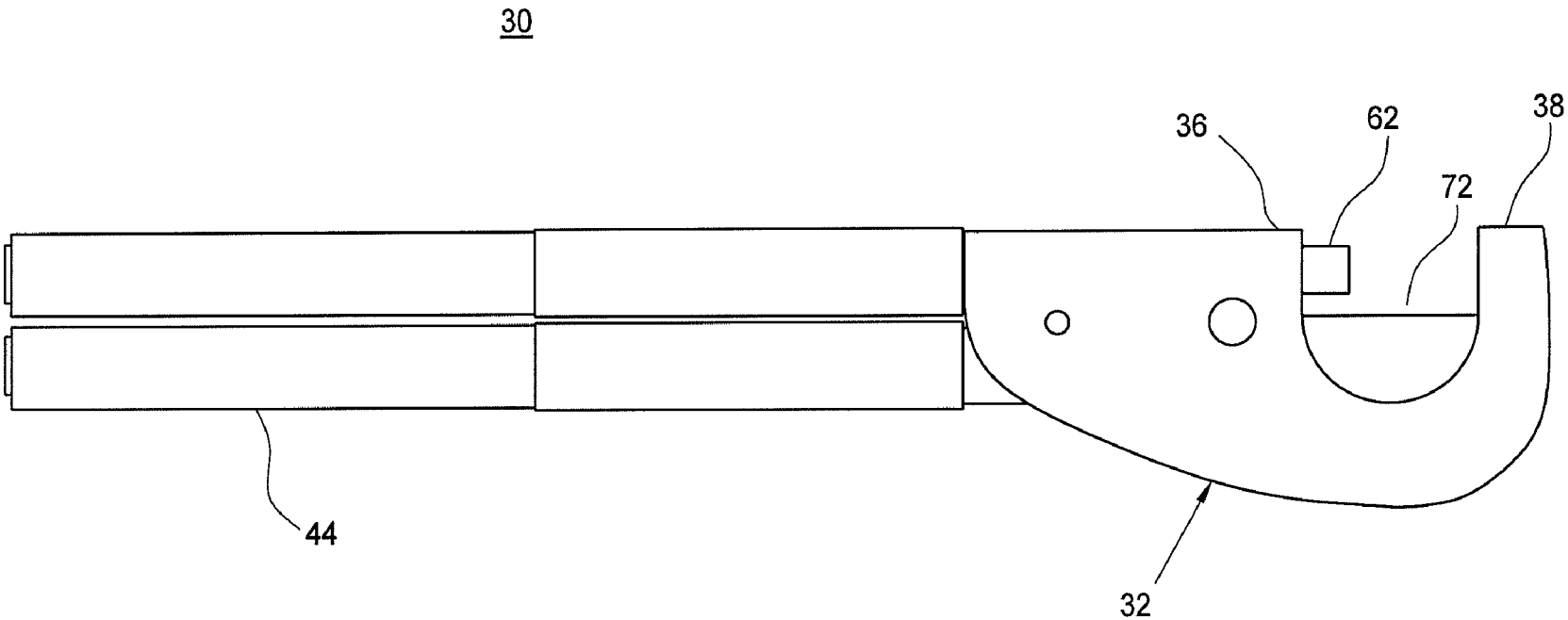
FIG. 4 depicts the crimping tool embodiment of FIG. 4 with the handles in the closed position.

Referring to FIGS. 3 and 4, there appears a first embodiment crimping tool 30 having a head 32 defining a jaw opening 34. The jaw opening 34 is bounded on three sides by an inner jaw member 36, an outer jaw member 38, and an intermediate jaw member 40, which is intermediate the inner and outer jaw members. The inner and outer jaw members 36 and 38, respectively, include substantially parallel, facing surfaces which are spaced apart a distance D which is sufficient to receive, and preferably slightly larger than, the transverse extent of the transverse duct flange member 12 to be crimped. As used herein, the term "transverse duct flange" includes any rectangular duct flange of a type having a first portion extending transversely with respect to the axial direction of the duct and a second upstanding lip extending therefrom. The preferred types of transverse duct flange for use with the present invention are the well-known TDC and/or TDF types, although it will be recognized that the present invention may also be used with any other type of transverse duct flange having an upstanding peripheral lip that may be bent or crimped onto a corner connector. In the preferred TDC/TDF crimper embodiment, the distance D is approximately 1.5 inches (3.8 cm).

A first handle 42 extends from the head 32 and is rigidly affixed relative thereto. A second handle 44 is pivotally attached to the head 32 about a pivot pin 46 and is movable between an open position (see FIG. 3) and a closed position (see FIG. 4). If desired, hand grips 48, such as tubing, padding, or other hand grip material may be provided on all or part of the handles 42 and/or 44. In the depicted preferred embodiments, the second handle 44 is shown beneath (in the orientation shown) the first handle 42. It will be recognized that the pivoting handle 44 may be pivotally attached at other positions relative to the first handle 42, including above the first handle 42 or at other positions.

A ram or plunger 62 is slidably received within a plunger orifice 52 in the inner jaw member 36. A mechanical linkage or coupling is provided between the second handle 44 and the plunger 62 to cause reciprocating movement of the plunger 62 in response to pivoting movement of the handle 44. The plunger 62 moves from a retracted position within the jaw member 36 (see FIG. 3) to an extended position into the jaw opening 34 and toward the outer jaw member 38 (see FIG. 4) when the handle is moved from the open position to the closed position. Optionally, a latch or fastener (not shown) may be provided to retain the handles in the closed position, e.g., for more compact storage when the tool is not in use.

Figure 6:
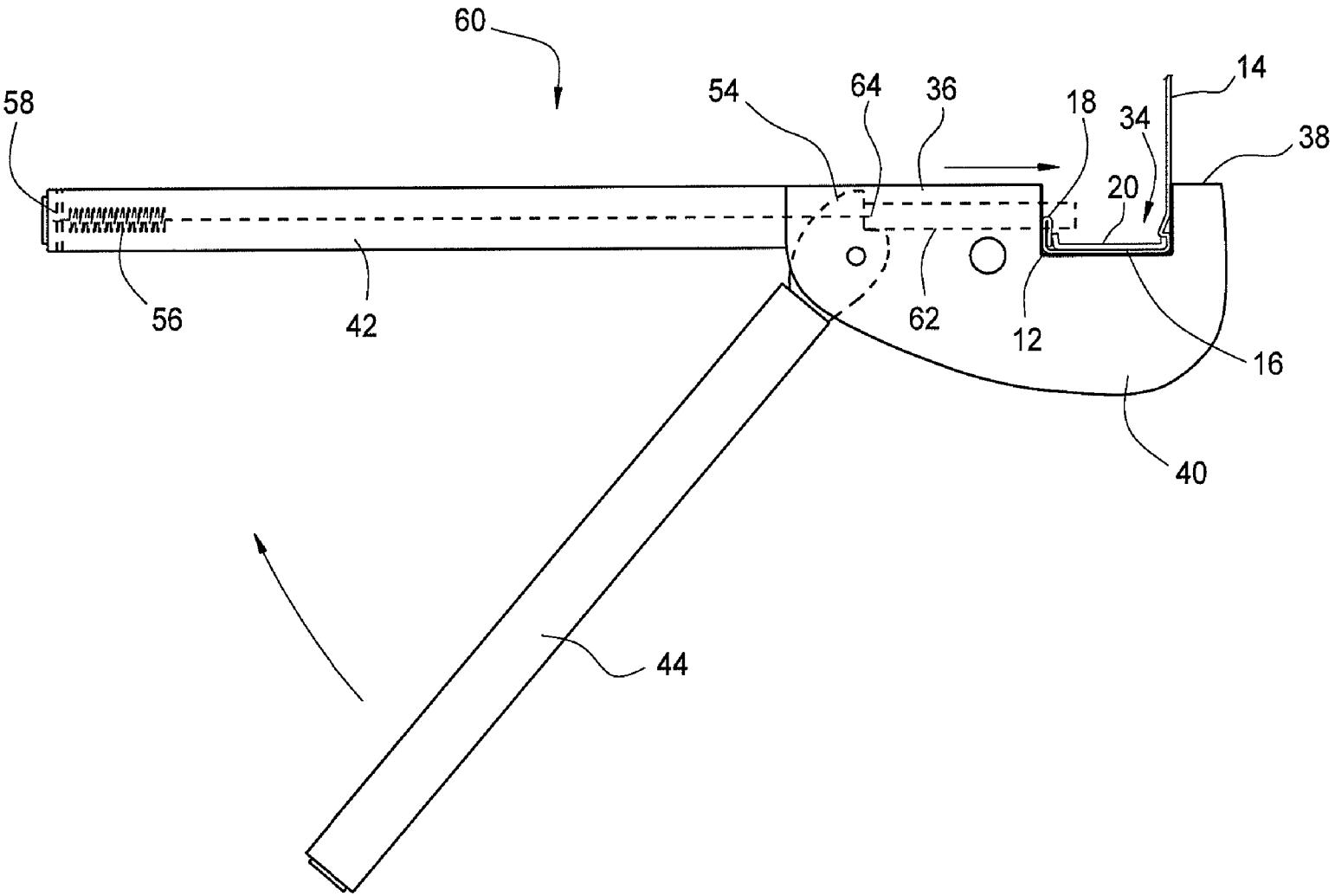
FIG. 6 depicts a crimping tool in accordance with a third embodiment.

Any mechanical coupling or linkage capable of producing a reciprocating sliding movement of the plunger 62 in response to pivoting movement of the handle 44 may be employed. Referring now to FIG. 6, there is shown a hand tool embodiment 60 illustrating a first exemplary coupling means including a pivoting cam 54 attached to the handle 44 and which bears against the plunger 62. A spring 56 received within a channel formed in the first handle 42 includes a first end 58 affixed therein and a second end 64 attached to the plunger 62. When the second handle 44 is moved to the closed position, the cam 54 bears against the plunger 62 and the plunger 62 is thereby moved to the extended position against the urging of the spring 56. When the second handle 44 is released, the spring urges the plunger 62 back to the retracted position and the handle 44 back to the open position.

Figure 7:
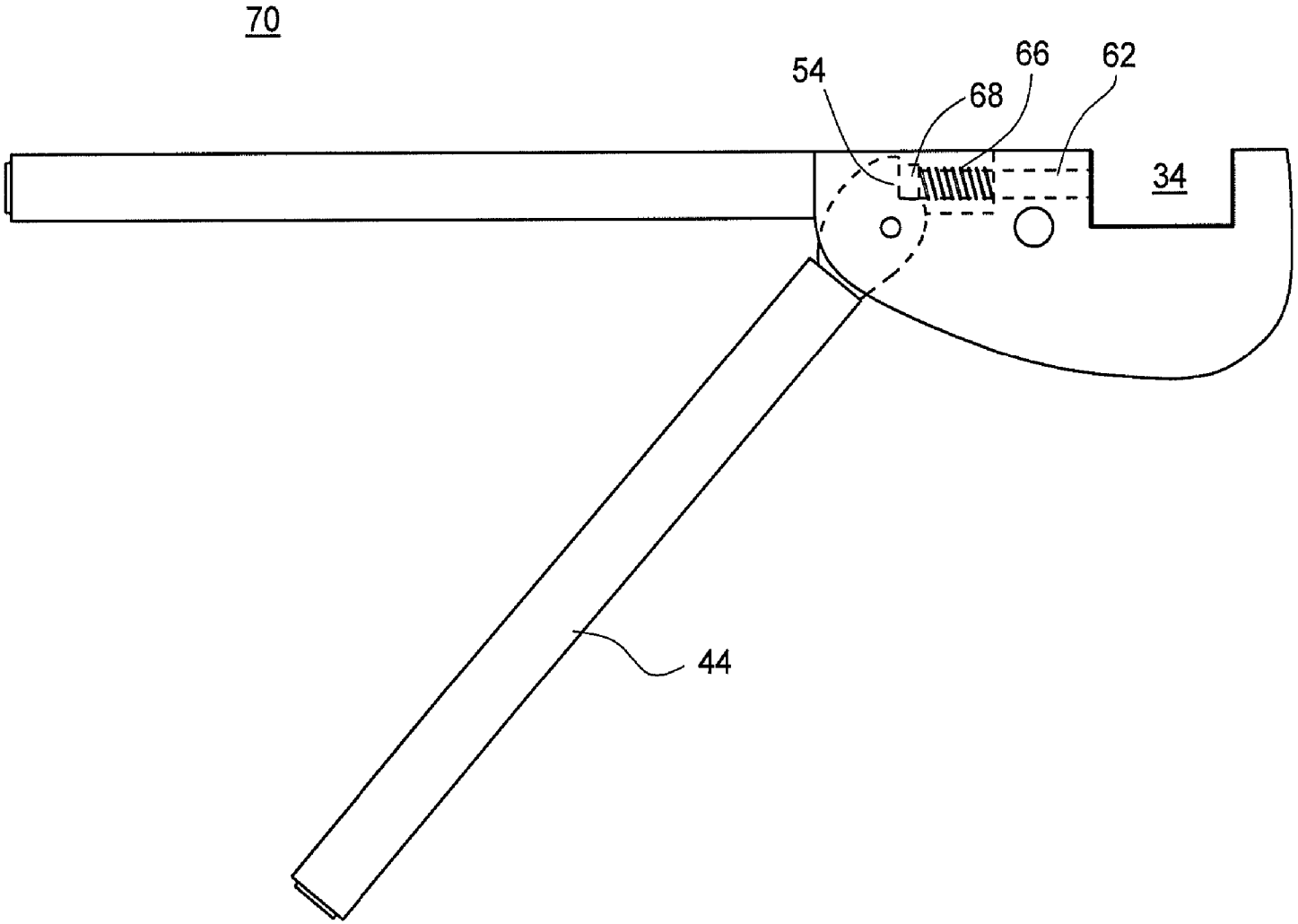
FIG. 7 depicts a crimping tool in accordance with a fourth embodiment.

Referring now to FIG. 7, there appears a hand tool embodiment 70 illustrating a second exemplary mechanical coupling means wherein a pivoting cam arm 54 attached to the handle 44 bears against an enlarged base 68 of the plunger 62. A spring 66 is coaxially disposed about the plunger 62. In operation, the second handle 44 is moved to the closed position and the cam 54 moves the plunger 62 to the extended position against the urging of the spring 66. Upon release of the handle 44, the spring 66 urges the plunger to the retracted position and the handle 44 returns to the open position. It will be recognized that the depicted mechanical linkages between the ram 62 and the pivoting handle 44 are exemplary and illustrative only and that all manner of linkages or mechanical couplings for actuating the ram 62 are contemplated, as would be understood by persons skilled in the art.

Figure 1:
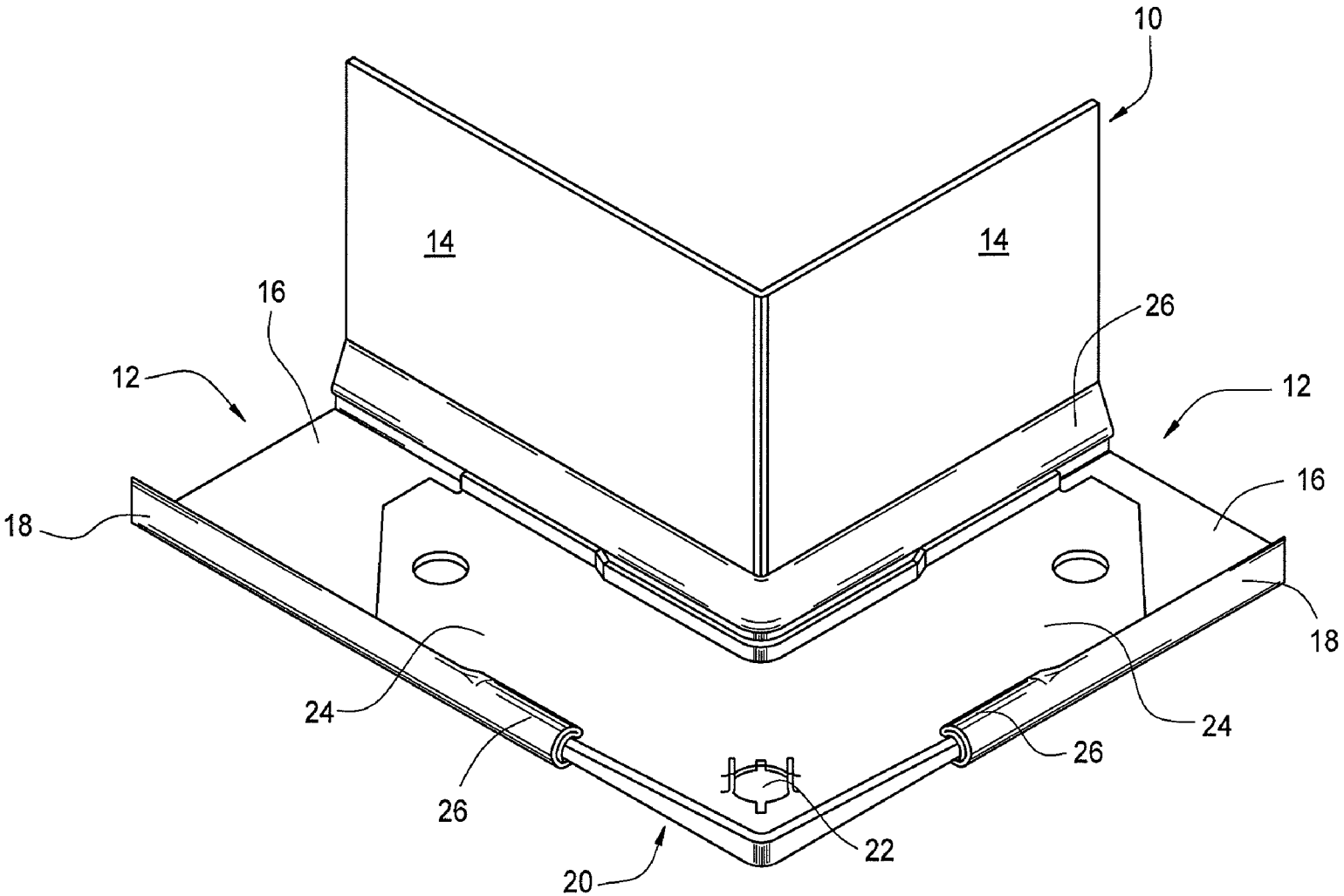
Fig. 1 (PRIOR ART)
FIG. 1 is a fragmentary view of an exemplary prior art transverse duct flange having a corner connector secured therein by crimping.
Figure 2:
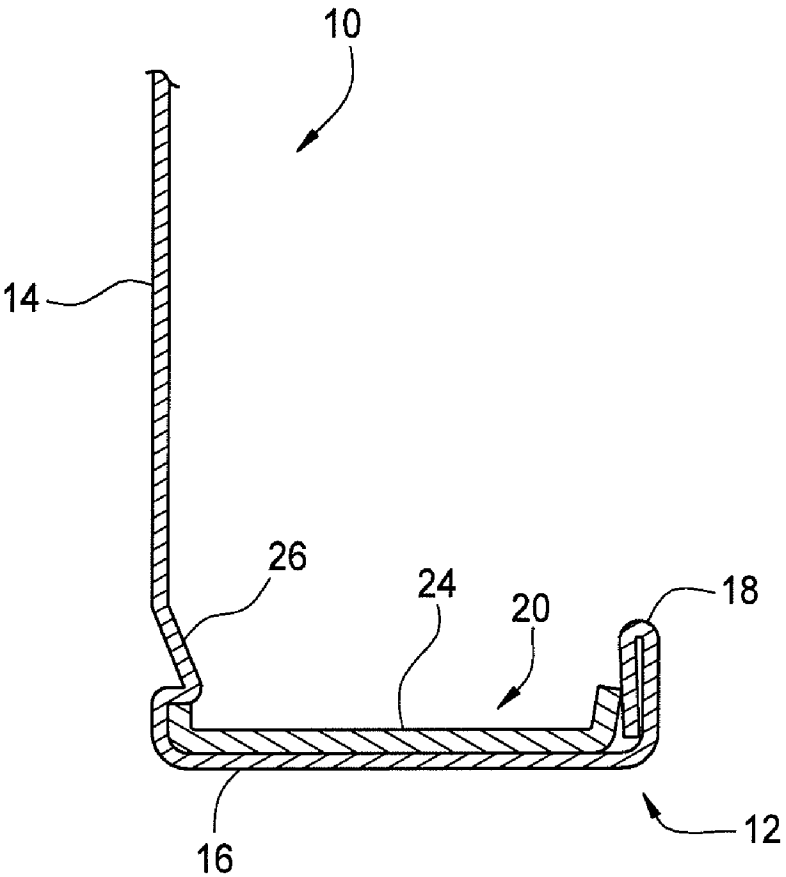
Fig. 2 (PRIOR ART)
FIG. 2 is cross-sectional view of the exemplary prior art corner connector within the transverse flange of FIG. 1, prior to bending or crimping the flange upstanding lip.

The manner of operation of the present hand tool can best be seen in FIG. 6. In operation, the tool 60 is placed about a transverse duct flange member 12 having a corner connector 20 to be connected via crimping thereto. The tool 60 is placed near the duct corner and the transverse flange portion 12 is seated against the intermediate jaw portion 40 so that the duct wall 14 is adjacent the outer jaw member 38 and the upstanding lip portion 18 is adjacent the inner jaw member 36. When the second handle 44 is moved from the open position to the closed position, the reciprocal movement of the plunger 62 toward the outer jaw member 38 causes the upstanding lip 18 to be bent over the corner connector 20. The handle 44 is released and the operation may be repeated one or more times at successive adjacent positions to form the desired crimped connection 26 (see FIG. 1). The procedure is then repeated for each leg 24 of each corner connector 20 that is to be attached to the duct section 10.

The jaw opening 34 may be sized to accommodate the transverse duct flange member 12 via a number of methods. For example, as shown in the embodiment of FIGS. 3 and 4, an insert 72 may be secured within the jaw opening of a rivet squeezer such as an aircraft rivet squeezer having a generally C-shaped jaw opening. The insert 72 may be secured via one or more of welding, mechanical fasteners, adhesives, or the like. The insert 72 is of a size and shape to define a generally rectangular jaw opening 34 and, upon seating a transverse duct flange member 12 within the jaw opening, to bring the upstanding lip 18 of a transverse duct flange 12 to a position relative to the plunger 62 so as to be bent over the corner connector 20 when the handle 44 is pivoted to the closed position.

Figure 5:
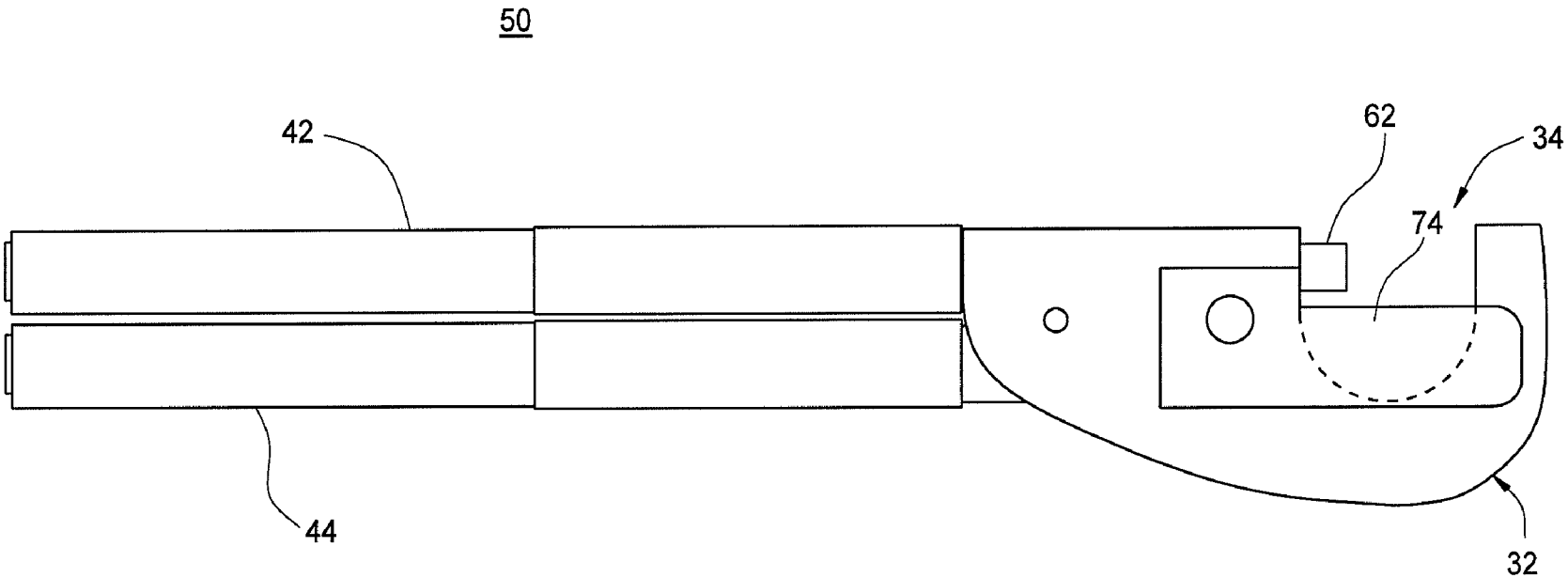
FIG. 5 depicts a crimping tool in accordance with a second embodiment.

An alternative to the jaw opening insert 72 is shown in the hand tool embodiment 50 appearing in FIG. 5. As shown in FIG. 5, a rivet squeezer with a generally C-shaped jaw opening may alternatively be modified by welding or otherwise fastening or securing a plate 74 to one or both sides of the tool head 32 at a position adjacent the jaw opening. The plate 74 is of a size and shape to define a generally rectangular jaw opening 34 and, upon seating a transverse duct flange member 12 within the jaw opening 34, to bring the upstanding lip 18 of a transverse duct flange member 12 to a position relative to the plunger 62 so as to be bent over a corner connector 20 when the handle 44 is pivoted to the closed position.

In still further embodiments, as shown in connection with the tool 60 of FIG. 6 and the tool 70 of FIG. 7, the inner, outer, and intermediate jaw members 34, 36, and 38, respectively, may be integrally formed of appropriate dimensions to define a generally rectangular jaw opening 34 and, upon seating of a transverse duct flange 12 within the jaw opening 34, to bring the upstanding lip 18 of a transverse duct flange member 12 to a position relative to the plunger 62 so as to be bent over a corner connector 20 when the handle 44 is pivoted to the closed position.

Figure 8:
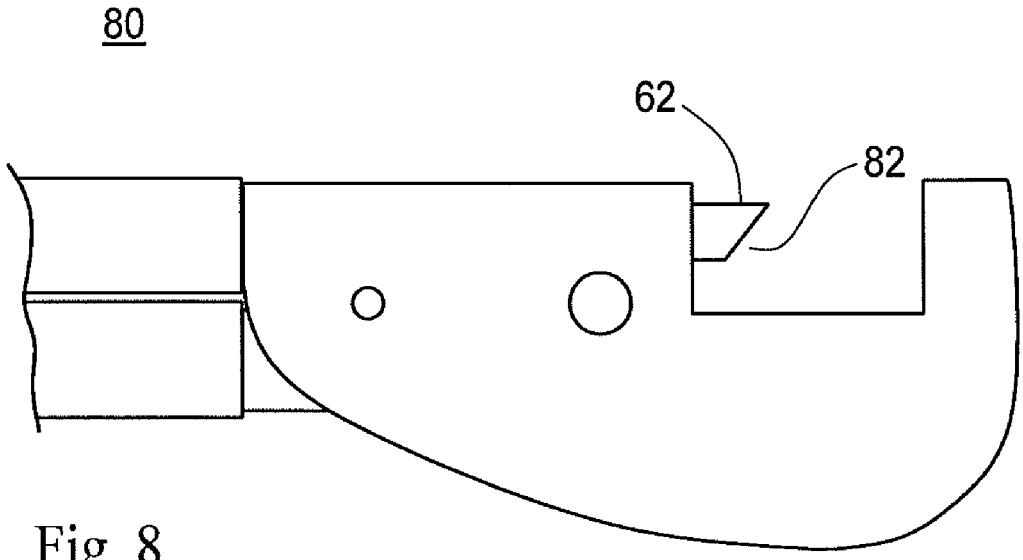
FIG. 8 depicts a crimping tool in accordance with a fifth embodiment.

The plunger 62 may be any of a number of geometric configurations. Preferably, the plunger 62 has a generally circular cross-sectional shape, although rectangular and other cross-sectional shapes are contemplated. In certain embodiments, the plunger 62 may have a bearing surface which is generally perpendicular to the direction of travel (see FIGS. 4-7). In other embodiments, the bearing surface may be inclined with respect to the axial direction to provide increased mechanical advantage and thus ease of operation. Referring now to FIG. 8, there is shown a fragmentary view of an exemplary tool 80 embodiment in which the plunger 62 includes an angled or inclined planar bearing surface 82. The angle of incline of the bearing surface 82 with respect to the axial direction of the plunger 62 is preferably in the range of from about 30-60 degrees and more preferably about 45 degrees.

Figure 9:
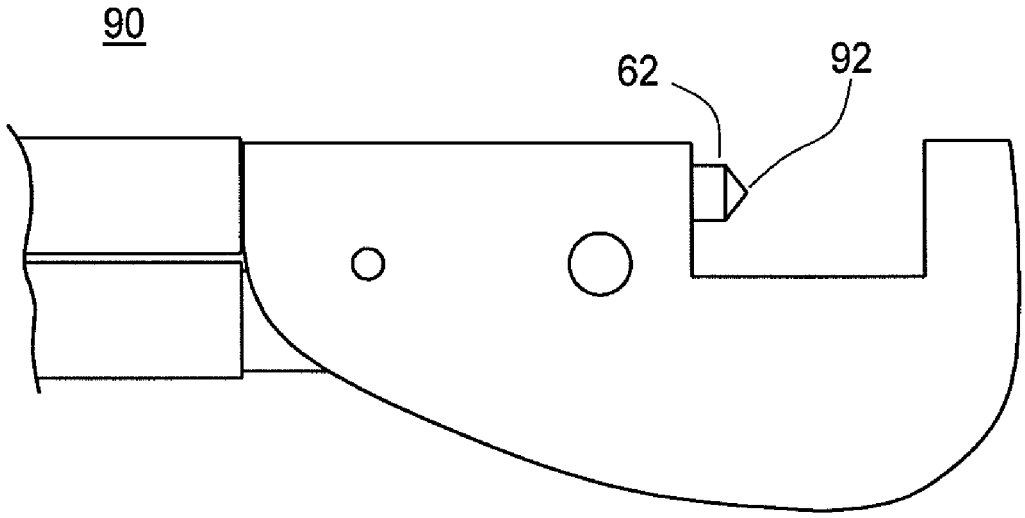
FIG. 9 depicts a crimping tool in accordance with a sixth embodiment.

Referring now to FIG. 9, there is shown a fragmentary view of an exemplary tool 90 embodiment in which the plunger 62 includes an generally conical bearing surface 92. The angle of incline of the conical bearing surface 92 with respect to the axial direction of the plunger 62 is preferably in the range of from about 30-60 degrees and more preferably about 45 degrees. The inclined bearing surfaces shown in FIGS. 8 and 9 are exemplary only and other tapered or inclined geometric configurations are contemplated, such as frustoconical, pyramidical, frustopyramidical, and others.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A method for securing a corner connector within a transverse duct flange of a rectangular duct section, said method comprising:

placing first and second legs of the corner connector within first and second adjacent flange portions of the rectangular duct section, each of the flange portions including a transverse portion and an upstanding lip, the transverse portion extending transversely between a wall of the rectangular duct section and the lip;

providing a crimping tool of a type having a head defining a generally rectangular jaw opening sized to receive the transverse duct flange, the head having an inner jaw member, an outer jaw member in spaced-apart, facing relation to the inner jaw member, and an intermediate jaw member extending between the inner and outer jaw members, said inner and outer jaw members spaced apart by a distance which is approximately equal to a transverse extent of the transverse portion of the transverse duct flange, a first handle extending from the head, a second handle pivotally attached to the head and movable between a first, open position and a second, closed position, a plunger slidably received within a plunger orifice formed within the inner jaw member and mechanically coupled to the second handle wherein pivoting movement of the second handle from the open position to the closed position causes sliding movement of the plunger from the inner jaw member toward the outer jaw member, the plunger completely received within the plunger orifice when the second handle is in the open position providing a clearance for the transverse duct flange to enter the jaw opening until the transverse portion of the transverse duct flange is fully seated within the generally rectangular jaw opening, the plunger and plunger orifice positioned within the inner jaw member so as to be adjacent the lip portion of the transverse duct flange when the transverse portion of the transverse duct flange is fully seated within the generally rectangular jaw opening, and the plunger and plunger orifice further positioned so that movement of said second handle from the open position to the closed position will cause the plunger to exit the plunger orifice and slidingly move to act on the upstanding lip without acting on the corner connector when the transverse duct flange is fully seated within the jaw opening; and for each corner connector leg, seating the transverse duct flange into the jaw opening and moving the second handle to the closed position relative to the first handle so as to cause sliding movement of the plunger member transversely toward the outer jaw member, thereby bending a portion of the upstanding lip over an aligned portion of the corner connector leg.

2. The method of claim 1, wherein said transverse duct flange is selected from a TDC transverse duct flange and a TDF transverse duct flange.

3. The method of claim 1, further comprising:

attaching a stop member between the inner and outer jaw members, the stop member further defining the generally rectangular jaw opening and configured to bring the plunger into alignment with at least a portion of the lip when the transverse portion of the transverse duct flange abuts the stop member.

4. The method of claim 3, wherein the stop member is selected from:

an insert secured within the jaw opening; and one or more plates attached to the head and extending across the jaw opening.

5. The method of claim 1, further comprising:

said plunger having a generally tapered end, said tapered end being tapered toward said outer jaw member.

6. The method of claim 5, wherein said tapered end includes a planar bearing surface inclined with respect to an axial direction of said plunger.

7. The method of claim 5, wherein said tapered end is conical in shape.

* * * * *